US006516649B1

(12) United States Patent
Mika et al.

(10) Patent No.: US 6,516,649 B1
(45) Date of Patent: Feb. 11, 2003

(54) PRESS BRAKE TOOLING PROVIDING STABILIZATION BETWEEN DIE AND DIE HOLDER

(75) Inventors: Timothy Mika, Amery, WI (US); Paul T. Johnson, Stillwater, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 214 days.

(21) Appl. No.: 09/660,660

(22) Filed: Sep. 13, 2000

(51) Int. Cl.[7] ..... B21D 5/02; B21D 37/04; B21D 37/14

(52) U.S. Cl. ..... 72/466.8; 72/389.3; 72/414; 72/462; 72/482.91; 72/482.92; 403/372

(58) Field of Search ..... 72/482.1, 482.91, 72/482.92, 482.93, 462, 414, 466.8, 389.3; 403/372

(56) References Cited

U.S. PATENT DOCUMENTS 953,305 A 3/1910 Summers
2,105,391 A * 1/1938 Almdale ..... 72/482.91
3,702,558 A 11/1972 Swenson et al.
4,787,237 A 11/1988 Houston et al.
5,022,256 A * 6/1991 Van der Meulen ..... 72/462
5,284,069 A * 2/1994 Wellman ..... 72/482.91
5,460,027 A * 10/1995 Takahashi ..... 72/482.91
5,513,514 A * 5/1996 Kawano ..... 72/389.3
6,263,721 B1 * 7/2001 Kawano ..... 72/462

* cited by examiner

*Primary Examiner*—David Jones
(74) *Attorney, Agent, or Firm*—Fredrikson & Byron, P.A.

(57) ABSTRACT

A press brake die holder for holding a press brake die having an upper, work-contacting surface and a lower, elongated tang. The die holder has an elongated body having a slot defined by opposing walls, the slot being configured to receive the tang of the press brake die. One of slot walls has a cavity opening into the slot toward the other slot wall, and a resilient plug is received in the cavity and protrudes into the slot toward the other wall. As the tang is received in the slot, the resilient plug contacts and urges the tang resiliently into contact with the other slot wall to restrain the tang from wobbling in the slot.

11 Claims, 4 Drawing Sheets

PRESS BRAKE TOOLING PROVIDING STABILIZATION BETWEEN DIE AND DIE HOLDER

FIELD OF THE INVENTION

This invention is in the field of press brake tooling used to bend sheet metal workpieces, and particularly to the dies and die holders employed in such tooling.

BACKGROUND OF THE INVENTION

Tooling for use with a press brake commonly includes a horizontally elongated punch having a downwardly-facing, generally V-shaped punch tip, and a horizontally elongated die that has an upwardly open, generally V-shaped workpiece-contacting portion adapted to receive the punch tip in a workpiece bending operation.

Because of the substantial forces involved in bending operations, it is important that the punches and dies be kept in alignment to avoid undue wear or, more importantly, breakage with resulting danger to press brake operators. Commonly, the press brake punch is fixed in position, and the press brake die, mounted in a press brake die holder, can be positionally adjusted into precise alignment with the punch tip. The die holder is then locked in position for the purpose of restraining lateral movement between punch and die.

Press brake dies commonly have a downwardly extending tang, generally rectangular in cross section, that is received in an upwardly open, complimentary shaped slot in a die holder. Set screws, inserted from the side of the die holder, may be employed to lock the tang within the holder slot. More commonly, however, the fit between the die tang and die holder is sufficiently close that no further locking is provided, and as a result, the die can be removed from he die holder with some ease.

Particularly in the latter case, however, in which a generally rectangular tang is received in a complimentary shaped slot in the die holder, some slight back and forth rocking motion or "wobble" of the die within the holder occurs, and is difficult to avoid. A very small amount of wobble or play between the die tang and the slot is magnified at the level that the upper surfaces of the die meet the punch tip. It is difficult to economically obtain tolerances between the die tang and die holder that would prevent such movement. If most of the wobble is to be avoided through the use of extremely close tolerances in the machining of the tang and slot, the cost of machining may become economically prohibitive. Also, the use of very close tolerances between the tang and die holder renders it difficult to properly insert the tang into and remove the die from a die holder.

Various die and die holder combinations are shown in U.S. Pat. No. 4,787,237 (Houston et al.) and U.S. Pat. No. 3,702,558 (Swenson et al.). It would be desirable, without requiring the presence of set screws or the like to rigidly position a die in a die holder, to provide a die and die holder in which the die could be easily inserted in and removed from the die holder, but, once inserted, the die would be restrained from wobble with respect to the die holder.

BRIEF SUMMARY OF THE INVENTION

We have found that we can employ one or more resilient plugs that protrude into the slot of the die holder to resiliently urge the tang of the die against one of the walls forming the slot in the die holder, thereby restraining wobble in the die.

In accordance with one aspect of the invention, the invention relates to a press brake die holder for holding a die having an upper, work-contacting surface and a lower, elongated tang in which the die comprises a body having a slot defined by opposing walls and adapted to receive between them the tang of the punch. At least one of the walls is provided with a cavity opening into the slot, and a resilient plug is received and retained in the cavity and protrudes into the slot toward the other wall. As the tang of the die is received in the slot, the resilient plug urges the tang resiliently into contact with the other wall to restrain the tang from wobbling in the slot.

The tang of the die is generally rectangular in shape, having generally parallel, vertical walls. Similarly, the slot of the die holder is rectangular in cross section, having opposed walls that confront the parallel, vertical walls of the tang. Preferably, the plug and the cavity in which the plug is received desirably are elongated in a direction parallel to the plane of the wall from which the plug protrudes.

In one preferred embodiment, a plurality of spaced, generally vertical bores is formed in the die holder body adjacent one of its walls, with the bores opening into the slot. Resilient, generally cylindrical plugs are received in the respective bores and protrude into the slots to contact the confronting wall of a die tang and force that tang against the opposing slot wall to thus restrain the die from wobbling in the die holder.

In another preferred embodiment, the bore or bores formed in the die holder body adjacent one of its walls extend instead in the long direction of the die holder, that is, generally horizontally, and open onto the slot. One or more resilient, generally cylindrical plugs are received in the respective bores and protrude into the slot to contact the confronting wall of a die tang and force that tang against the opposing slot wall to thus restrain the die from wobbling in the die holder.

DESCRIPTION OF THE PREFERRED EMBODIMENT

Figure 1:
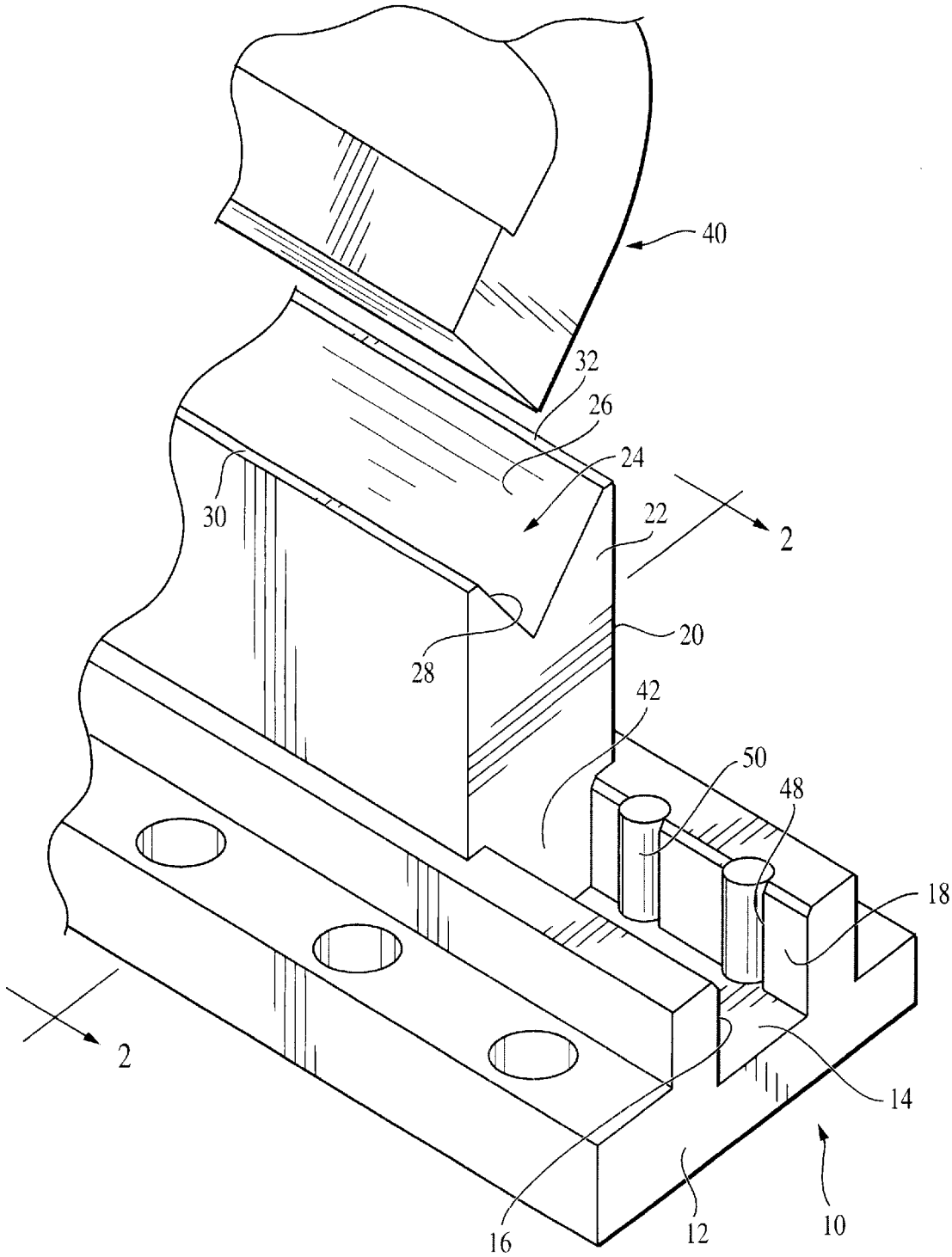
FIG. 1 is a broken away view showing a die holder of the invention together with a die held therein and, for purposes of illustration, a punch.

The die holder of the invention is designated generally as 10 and comprises a body 12 having an upwardly open slot to 14 formed therein, the slot being generally rectangular in cross section and having opposed, parallel sidewalls 16, 18. A press brake die 20, of known design, includes an upper portion 22 having a generally V-shaped groove 24 formed therein by upwardly divergent, intersecting walls 26, 28, these walls terminating upwardly in edge surfaces 30, 32 which are smooth and gently rounded to enable the work piece to slide readily over these surfaces during a bending operation. A punch, designated generally as 40, has a downwardly facing, V-shaped cross section that can be received in the V-shaped groove 24 during a bending operation. It will be understood that a work piece, not shown, is advanced between the punch 40 and die 20, and is bent when the punch descends into the die.

The die, at its lower end, has a tang 42 which is generally rectangular in cross section and which is dimensioned to fit closely between the walls 16, 18 of the slot 14. As depicted in FIG. 2, the tang has opposing, generally parallel walls 44, 46 which closely confront the respective walls 16, 18 of the slot 14 when the die is received in the die holder as shown in FIGS. 1 and 2.

Figure 2:
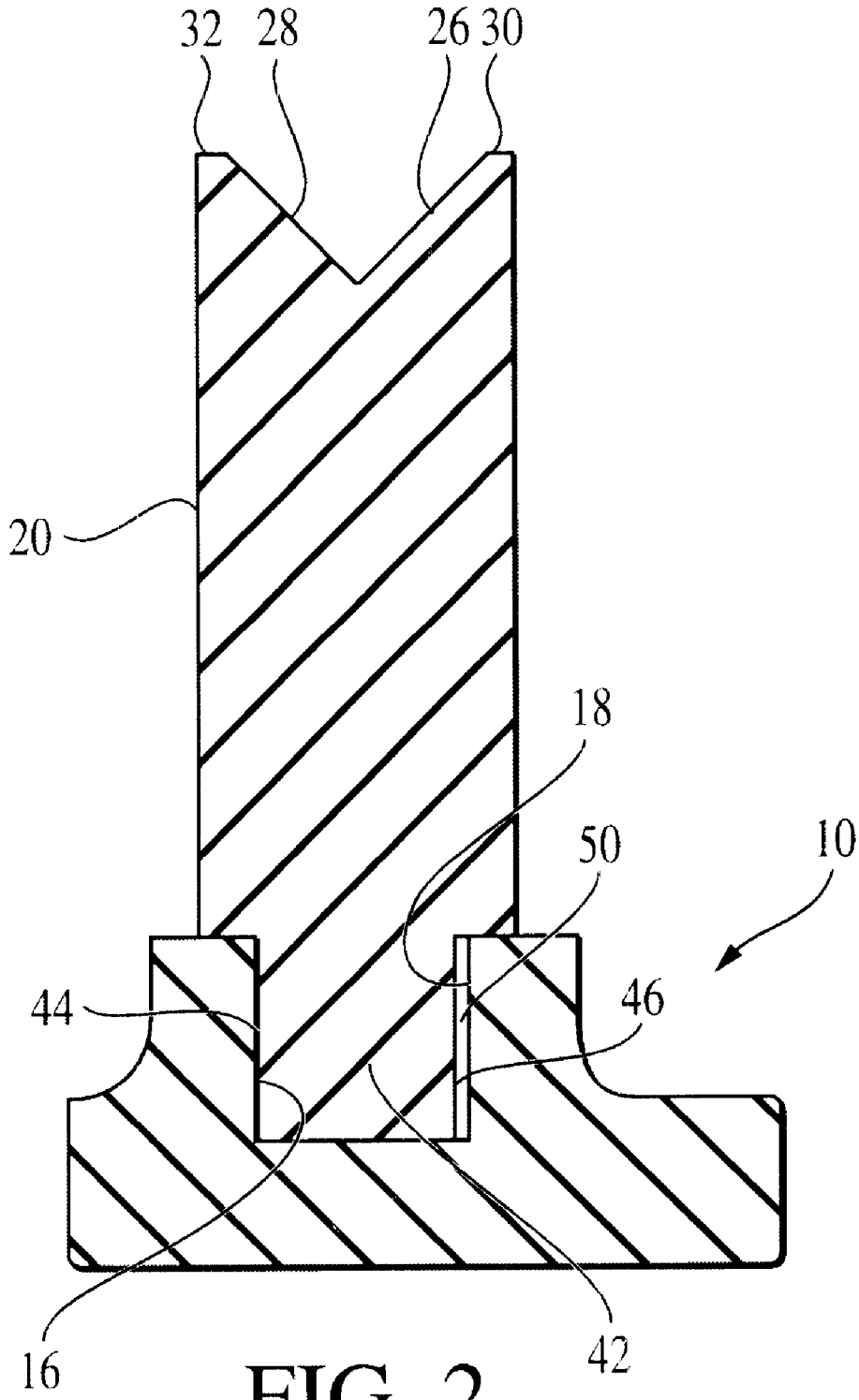
FIG. 2 is a cross sectional view of the die and die holder of FIG. 1, taken along line 2—2 of FIG. 1.

Referring to FIG. 1, it will be seen that cavities in the form of vertical bores 48 are formed in the body 12 of the die holder, the bores being shaped and sized so as to open into the slot 14, as shown. The bores are spaced from one another along substantially the entire length of the die holder.

Within the bores 48 are received resilient, generally cylindrical plugs 50. The resilient plugs, as shown in FIGS. 1 and 2, protrude outwardly slightly of the bores where the bores open onto the die holder slot 14. Protrusion of the plugs 50 into the slot by a distance of about 0.001 to about 0.015 inches is preferred. It will be understood that the plugs protrude into the slot for a distance such that the width of the slot, measured from the face of a plug to the opposite wall, is slightly less than the width of the die tang so that as the tang is forced into the slot, the plugs compress slightly. The plugs desirably have a smooth cylindrical surface against which the bottom edge of the die tang can slide easily without damage to the plugs.

Figure 3:
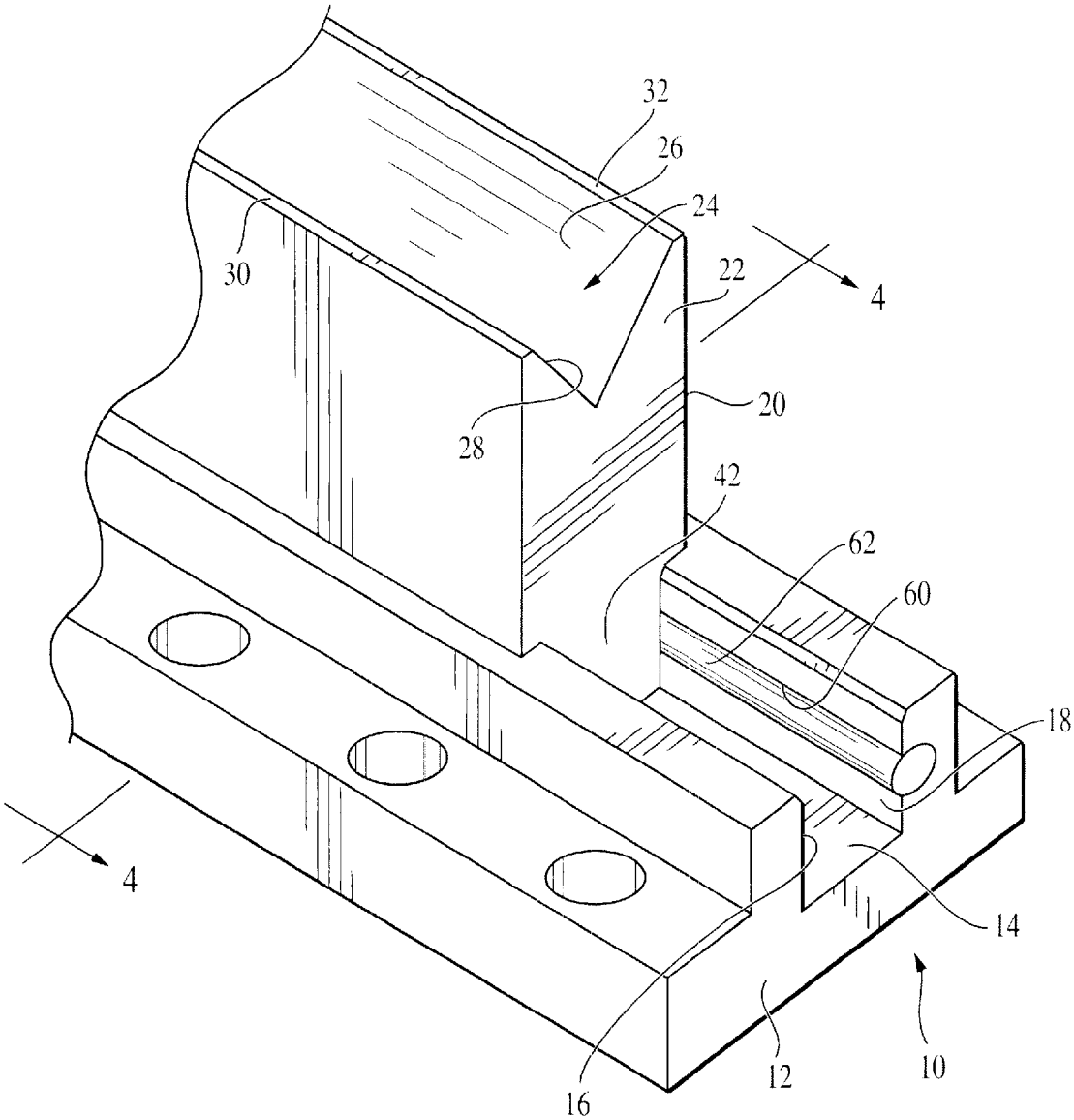
FIG. 3 is a broken away view showing an alternate embodiment of die holder of the invention together with a die held therein.
Figure 4:
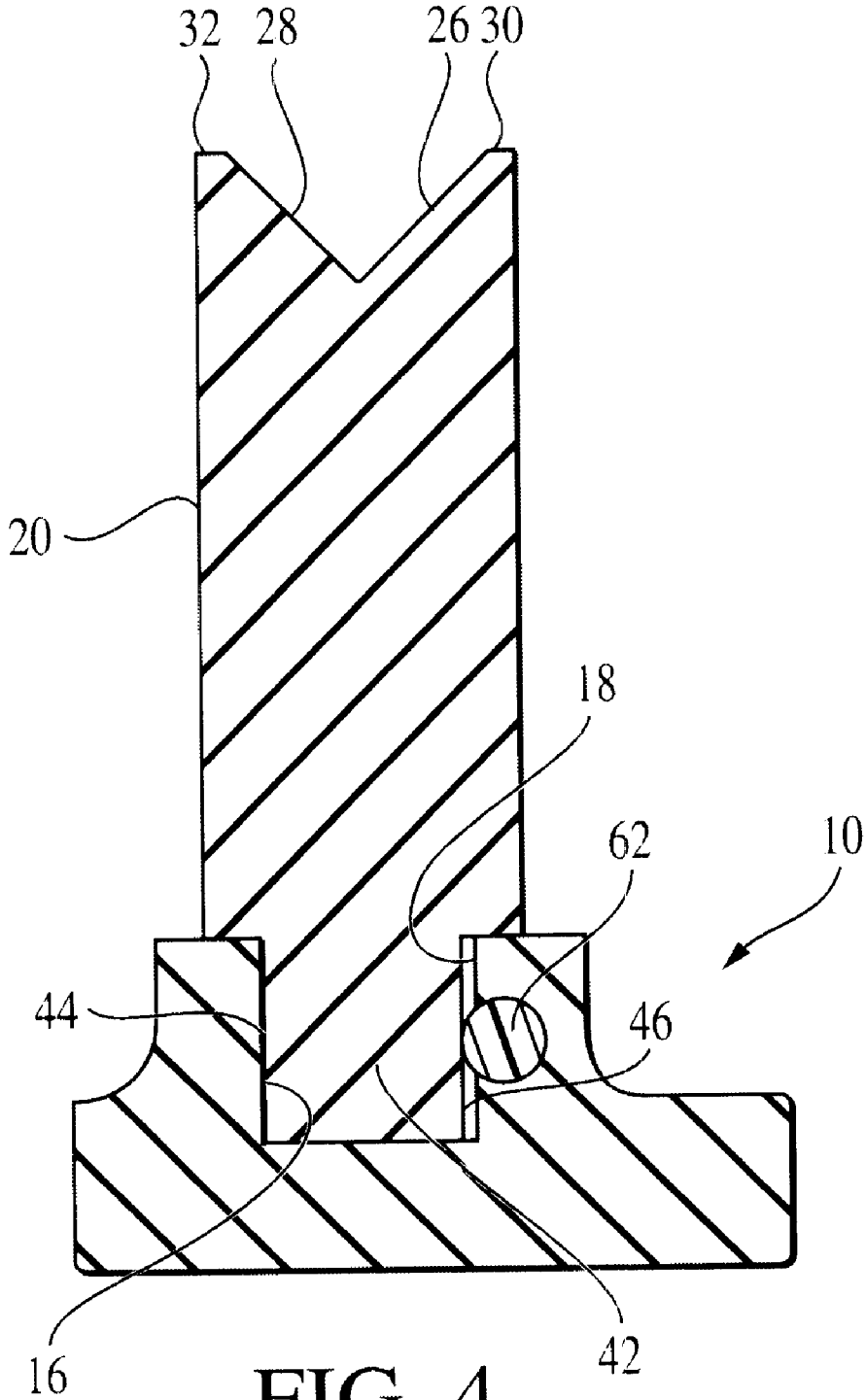
FIG. 4 is a cross sectional view of the die and die holder of FIG. 3, taken along line 4—4 of FIG. 1.

FIGS. 3 and 4 illustrate another preferred embodiment of the invention. This embodiment, in comparison to the embodiment of FIGS. 1 and 2, provides a longitudinal cavity 60 in the body 12 of the die holder, the bore being formed so as to open outwardly through the wall 18 into the slot 14. The cavity 60 can be made by any convenient means, as, for example, by use of a Woodruff cutter. In this embodiment, the bore or cavity 60 runs in the elongated direction of the die and die holder, that is, parallel to the longitudinal direction of the slot 14. Received within the bore 60 is a resilient, elongated plug 62 of the type referred to above, the walls of this plug protruding slightly into the slot 14 for contact with the confronting tang surface.

As with the embodiment of FIGS. 1 and 2, the plug 62 protrudes into the slot 14 a sufficient distance to encounter and resiliently press against the confronting wall 46 of the die tang 42, urging the other wall 44 of the tang into contact with the opposing wall 16 of the slot. The plug 62 may be made of a single length of material, such as a polyurethane elastomer, or may be made in sections of plugs of this type. The plug 62 preferably is continuous along the length of the cavity, but there may be gaps in the plug as desired. Also, although but a single plug 62 is shown in the embodiment of FIGS. 3 and 4, it will be understood that two or more plug-retaining slots can be employed. It may, for example, be desirable to provide plug-retaining slots, one above the other, in the embodiment shown in FIG. 3.

A variety of materials can be employed for the plugs. Polyurethane or other resilient plastics are preferred. The surfaces of the plugs that protrude into the die holder slot desirably have a hardness in the range of 60–95 Durometer A, with a hardness in the range of about 85–90 Durometer A being preferred. Put another way, the plugs are sufficiently resilient so that their surfaces can be slightly dented by fingernail pressure. The plugs depicted in the drawing are generally cylindrical in shape, and although this configuration is currently preferred, it will be understood that the plugs could be made with different configurations as well, as, for example, in the form of buttons, spheres, or the like, it being required only that the plugs protrude outwardly into the die holder slot 14 a sufficient distance to resiliently encounter the confronting vertical surface 46 of the die tang and allow the die tang to thus be manually inserted in the die holder slot. Inasmuch as press brake dies commonly are mounted and removed from holders by hand, it is desired that the pressure exerted by the plugs against the tang not be so great as to unduly interfere with this process. The pressure thus exerted can be varied as desired by, e.g., controlling the distance that the plugs protrude into the slot 14 and by varying the resilience of the material from which the plugs are made. The pressure thus exerted can also be adjusted by adjusting the amount of contact that is permitted between the plugs and the die tang, and this can be managed by adjusting the spacing between plugs in the embodiment of FIGS. 1 and 2, and by providing gaps between lengths of plug material in the embodiment of FIGS. 3 and 4.

If desired, an adhesive can be employed between the walls of the plugs and the cavities within which they are received for the purpose of restraining the plugs from coming out of the cavities when the die is removed from the die holder. Also, if desired, the cavity 48 (FIGS. 1 and 2) may be formed with a slightly wider diameter portion near the bottom of the bore (formed, for example, by drilling up from beneath the die holder) so as to provide a sharp, downwardly facing shoulder to grip and retain a plug in the cavity. Various other configurations will be apparent to those skilled in the art. In the preferred embodiments, the cavities are generally cylindrical, but have diameters substantially greater than the width of the openings through which the plugs protrude so as to prevent the plugs from escaping from the cavities into the slot 14.

In use, once the plugs have been inserted into the cavities, the tang of a die can be received in the slot 14. This is perhaps most readily accomplished by tilting the die slightly so that the bottom edge of the tang furthest from the plugs 50 first encounters the wall 16, with the opposing wall 46 of the tang initially engaging the top of the plugs. As the die is advanced into the slot, the sidewalls 44, 46 of the die tang quickly come into parallelism with the confronting walls 16, 18 of the die holder. Some manual force, of course, is needed to mount the die in the die holder and to remove the die from the holder.

While a preferred embodiment of the present invention has been described, it should be understood that various changes, adaptations and modifications may be made therein without departing from the spirit of the invention and the scope of the appended claims.

What is claimed is:

1. A press brake die holder for holding a die having an upper, work-contacting surface and a lower, elongated tang, the die holder comprising an elongated body having an elongated slot defined by opposing walls and adapted to receive the tang of said die, at least one of said walls being provided with a cavity opening into the slot, and a resilient plug received and retained in said cavity and protruding into said slot toward the other wall, whereby, as said tang is received in the slot, said resilient plug urges said tang resiliently into contact with the other of said walls to restrain the tang from wobbling in said slot.

2. The press brake die holder of claim 1 wherein said at least one slot wall is provided with a plurality of cavities spaced along the length of the elongated die holder body, and a plurality of said resilient plugs are received in respective ones of said cavities and protrude into said slot toward the other wall.

3. The press brake die holder of claim 2 wherein said cavities are generally cylindrical and are formed on axes that are parallel to the wall through which said cavities open into the slot, and wherein said resilient plugs are generally cylindrical and are configured to fit snugly within said cavities.

4. The press brake die holder of claim 3 in which said cavities are oriented to open from only one of said walls into the slot.

5. The press brake die holder of claim 1 wherein said at least one slot wall is provided with a plug-retaining cavity running parallel to the elongated slot.

6. The press brake die holder of claim 5 wherein said cavity is generally cylindrical and wherein said resilient plug is generally cylindrical and is configured to fit snugly within said cavity.

7. A die and die holder for use in a press brake, the die having an upwardly facing workpiece-contacting surface, and having a downwardly protruding tang, said die holder comprising a body having an upwardly open slot removably receiving said tang, said slot being defined by opposing side walls, one of said walls having a plurality of cavities formed therein that open onto the slot, and resilient plugs received and retained in said cavities and protruding into said slot, the plugs resiliently bearing against said tang to urge the tang into contact with the opposing slot wall, thereby reducing wobble between the die and die holder.

8. The press brake die holder of claim 7 wherein said resilient plugs protrude into said slot so that the width of the slot measured from the protruding portion of the plugs to the opposite slot wall is slightly less than the width of the die tang.

9. The press brake die holder of claim 7 wherein said cavities are generally cylindrical and are formed on axes that are parallel to the wall through which said cavities open into the slot, and wherein said resilient plugs are generally cylindrical and are configured to fit snugly within said cavities.

10. A die and die holder for use in a press brake, the die having an upwardly facing workpiece-contacting surface, and having a downwardly protruding tang, said die holder comprising a body having an upwardly open slot removably receiving said tang, said slot being defined by opposing side walls, one of said walls having a plurality of cavities formed therein that open onto the slot, and resilient plugs received and retained in said cavities and protruding into said slot to resiliently bear against said tang and urge the tang into contact with the opposing slot wall, thereby reducing wobble between the die and die holder.

11. A die and die holder for a press brake, the die comprising an upwardly facing workpiece-contacting portion and a downwardly extending, horizontally elongated tang having generally parallel, vertical walls, said die holder comprising a body having an elongated slot formed therein defined by spaced, vertical walls and configured to closely but removably receive said tang, said die holder body having an elongated cavity formed therein adjacent one of its walls and parallel to the elongated slot, said cavity opening into said slot, and a resilient, generally cylindrical plug received and retained in said bore and protruding into said slot to resiliently contact a confronting wall of a die tang and force the tang against the opposing slot wall to restrain the die from wobbling in the die holder.

* * * * *